US005248148A

United States Patent [19]

Toan

[11] Patent Number: 5,248,148

[45] Date of Patent: Sep. 28, 1993

[54] EDUCATIONAL WORD RHYMING GAME

[76] Inventor: W. Stephen Toan, 704 Brier St., Kenilworth, Ill. 60043

[21] Appl. No.: 5,473

[22] Filed: Jan. 15, 1993

[51] Int. Cl.[5] ..... H63F 3/00

[52] U.S. Cl. ..... 273/249; 273/272

[58] Field of Search ..... 273/242, 243, 248, 249, 273/272

[56] References Cited

U.S. PATENT DOCUMENTS

| | | | |
|---|---|---|---|
| D. 125,286 | 2/1941 | Podgurski . | |
| D. 134,515 | 12/1942 | Long . | |
| 641,739 | 1/1900 | Thompson . | |
| 1,445,819 | 2/1923 | Boyle . | |
| 1,635,734 | 7/1927 | Ziegler . | |
| 2,521,775 | 9/1950 | Brower | 273/272 X |
| 2,824,389 | 2/1958 | Orebaugh . | |
| 3,215,435 | 11/1965 | Rheingruber . | |
| 3,564,732 | 2/1971 | Lynd . | |
| 3,734,508 | 5/1973 | Snyder . | |
| 4,029,320 | 6/1977 | Hausman . | |
| 4,089,527 | 5/1978 | Roth . | |
| 4,123,051 | 10/1978 | Tsacoyannis . | |
| 4,340,231 | 7/1982 | Cammarata . | |
| 4,449,710 | 5/1984 | Davis | 273/249 |
| 4,557,985 | 12/1985 | Lardon | 273/249 X |
| 4,640,513 | 2/1987 | Montijo . | |
| 4,671,516 | 6/1987 | Lizzola et al. . | |
| 4,877,254 | 10/1989 | Yascavage . | |
| 4,923,199 | 5/1990 | Hahn . | |
| 4,993,718 | 2/1991 | Dandridge et al. . | |
| 5,067,720 | 11/1991 | Bundy | 273/272 X |
| 5,121,928 | 6/1992 | Salerno-Sonneberg | 273/243 |

FOREIGN PATENT DOCUMENTS

| | | | |
|---|---|---|---|
| 1238772 | 2/1969 | United Kingdom . | |
| 2066678 | 7/1981 | United Kingdom | 273/249 |
| 2223177 | 4/1990 | United Kingdom | 273/249 |

*Primary Examiner*—William Stoll

*Attorney, Agent, or Firm*—Shlesinger Arkwright & Garvey

[57] ABSTRACT

An educational word rhyming game includes a gameboard having a plurality of consecutive spaces defining a movement path, one of the spaces being a start space and one of the spaces a finish space. There are a number of gamepieces which are positionable on each of the plurality of spaces for movement along the movement path. A number of rhyming cards are likewise provided, each of the rhyming cards having at least one word on the face thereof. There can be provided a spinner having numbers on its face and a pointer, so that when a player spins the pointer will indicate how many rhymes a player must form corresponding to the number indicated on the spinner. Thus, when a player forms a number of rhymes at least equal to the number indicated by the pointer on the spinner, the player gets to move that number of spaces, thereby advancing toward the finish space.

9 Claims, 1 Drawing Sheet

FIG. 1
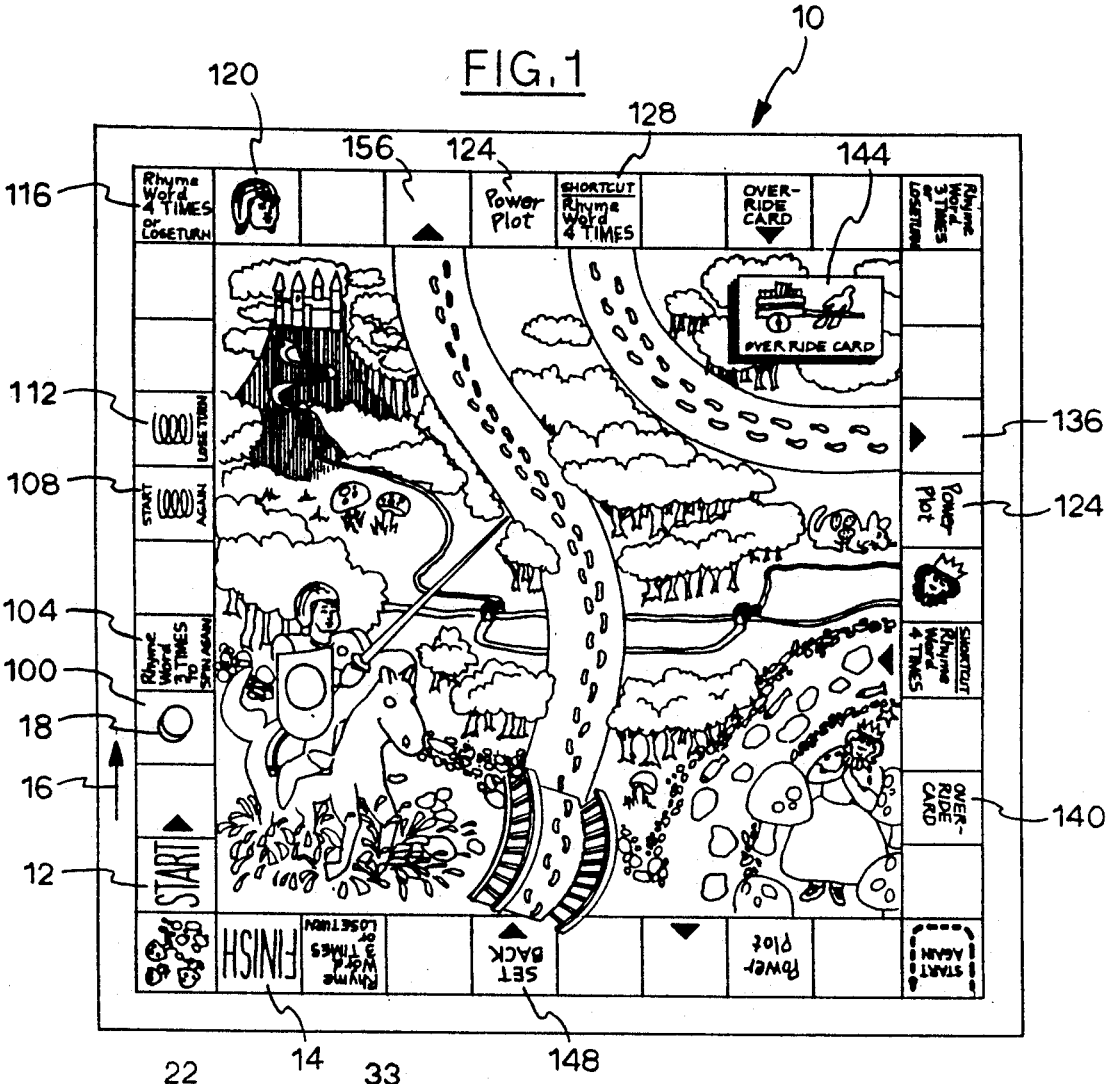
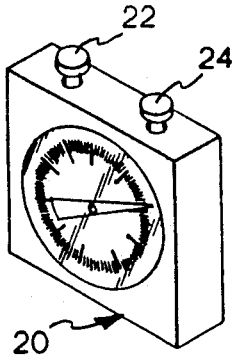
FIG. 2
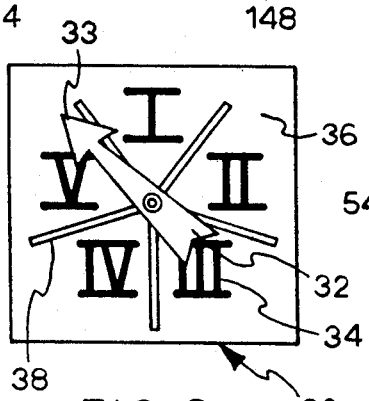
FIG. 3
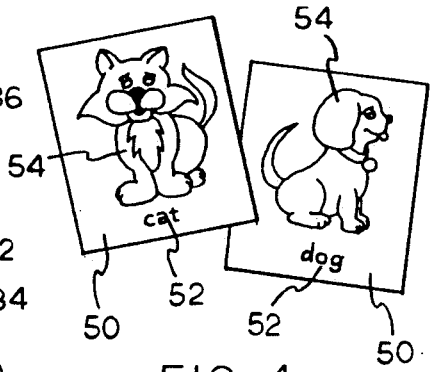
FIG. 4

EDUCATIONAL WORD RHYMING GAME

FIELD OF THE INVENTION

This invention is related to an educational word rhyming game, a gameboard, components adapted for carrying out the word rhyming game, and a method of playing such.

BACKGROUND OF THE INVENTION

The importance of activities which are educational, family-oriented, fun, and are relatively inexpensive is being increasingly recognized nowadays.

Accordingly, there is a need for educational games which can be played by all ages, teach, are low cost, and yet are fun to play.

It has been long recognized that children, and others, will learn better, and remember longer, if the educational material is presented in an amusing and entertaining format.

Earlier devices combining the rhyming of words, the forming of sentences, and playing games are set forth immediately below.

U.S. Pat. No. 641,739 to Thompson is a simple device in which a root suffix such as "at" is printed on a card having a number of circular holes therein. Word discs having words such as "hat" and "bat" are fitted into the holes. Today, this simple device would hold the attention of only the youngest users, and likely only in a classroom setting.

U.S. Pat. No. 3,564,732 to Lynd discloses a sheet of cloth or the like having the outline of a tree thereon, and pear-shaped pairs of tags to be affixed to the limbs. Each of the pear-shaped tags has a word thereon, each word being a homonym of another paired word. This straightforward teaching device shows that words in the English language that sound the same, and rhyme, often have different spellings.

U.S. Pat. No. 4,029,320 to Hausman discloses gamepieces which move along a path set out on a gameboard, various educational problems being set forth on different spaces of the gameboard, and shortcut paths being provided between some of the spaces and other spaces distant therefrom.

U S. Pat. No. 4,671,516 to Lizzola et al. is directed to a gameboard having a path of travel on which a player's gamepiece moves, each one of the spaces on the travel path being a word or words representative of different parts of speech and different sentence fragments. The players collect these sentence fragments and form sentences, while a timer is used to govern the overall length of the game.

British Patent No. 1,238,772, to Kremer, published 7 Jul. 1971, discloses a rhyming game in which a number of cards is provided. Each card has four illustrations and corresponding rhyming words thereon. One of the four rhyming words and pictures is illustrated larger than the others, respectively, so that matched sets of four cards are provided. The play is similar to the conventional card game of "Go Fish" in which players take turns asking other players for cards which belong to the matched set of four cards, for which the asking player is attempting to complete a set.

Accordingly, it can be seen that there exists a need for an educational word rhyming game which can be used by all age groups, is inexpensive, and is fun to play.

OBJECTS AND SUMMARY OF THE INVENTION

It is a first object of the invention to provide an educational word rhyming game which avoids the drawbacks of prior art educational game/devices.

Another object of the invention is to provide an educational word rhyming game which is inexpensive and easy to produce.

Yet another object of the invention is to provide an educational word rhyming game which is suitable for all ages of players.

Another object of the invention is to provide an educational word rhyming game which is amusing to play, so that the educational value thereof is enhanced.

A still further object of the invention is to provide an educational word rhyming game in which there is competition between a player and his or her own past performance, and there is competition between the player and other players of the game.

In summary, therefore, the invention is directed to an educational word rhyming game which is amusing, maintains the interest of the players, and has enhanced educational value.

In one preferred embodiment of the invention, the educational word rhyming game includes a gameboard having a plurality of consecutive spaces defining a movement path, one of the spaces being a start space and one of the spaces a finish space. There are a number of gamepieces which are positionable on each of the plurality of spaces for movement along the movement path. A number of rhyming cards are likewise provided, each of the rhyming cards having at least one word on the face thereof. There can be provided a spinner having numbers on its face and a pointer, so that when a player spins the pointer will indicate how many rhymes a player must form corresponding to the number indicated on the spinner. Thus, when a player forms a number of rhymes at least equal to the number indicated by the pointer on the spinner, the player gets to move that number of spaces, thereby advancing toward the finish space.

The invention will be further described with reference to the following drawings.

BRIEF DESCRIPTION OF THE DRAWINGS

FIG. 1 is a plan view of a preferred embodiment of a game board according to the invention;

FIG. 2 is a perspective view of a preferred embodiment of a timer forming a part of the educational rhyming game according to the invention;

FIG. 3 is a plan view of a preferred embodiment of a spinner forming part of the educational rhyming game according to the invention; and FIG. 4 is a plan view of preferred embodiment of word cards forming part of the educational word rhyming game according to the invention.

DETAILED DESCRIPTION OF THE INVENTION

Turning to FIG. 1, a gameboard 10 for use in a preferred embodiment of the educational word rhyming game according to the invention is shown.

Gameboard 10 includes a start space 12 and a finish space 14. An arrow 16 indicates the direction of travel of a gamepiece 18 from start space 12 to finish space 14. The large number of additional spaces defining the travel or movement path for gamepiece 18 will be described in greater detail below.

FIGS. 2–4 illustrate other basic components of the preferred embodiment of the educational word rhyming game according to the invention.

FIG. 2 shows a timer 20 in perspective that has a start switch or mechanism 22 and a stop switch or mechanism 24.

FIG. 3 illustrates a spinner 30 including a pointer 32 having a head 33 for pointing to one of multiple numbers 34 printed or otherwise formed on a base 36. A number of dividers 38 is likewise provided on base 36 for separating numbers 34, so that it is readily apparent to which selected one of numbers 34 head 33 of pointer 32 is being directed.

FIG. 4 is a plan view of a couple of word cards 50 forming another basic element of the educational word rhyming game according to the invention. Each card 50 includes a word 52 printed thereon, and a picture or pictograph 54 corresponding in some meaningful way to word 52.

Details of the invention will be best understood by considering the manner in which the invention is used.

OPERATION

To begin play, the one or more players who are going to play the game place gameboard 10 on a table, for example. Cards 50 are shuffled together and placed in an upside down stack in a suitable location on or near gameboard 10.

To determine the order of play, each player spins pointer 32, in turn. The player who has spun pointer 32 and had head 33 point to number 34 having the greatest value; i.e., five (V) in FIG. 3, goes first. The other players follow with the player having the next highest number going next and so forth. If two players spin and the same number 34 is designated by pointer 32, the players both spin again, for example.

After the order of play is determined, the first player uses spinner 30 again to determine the number of times the first player must form words which rhyme with card 50 selected from the upside down stack of cards 50.

Once the player has selected a card 50, he or she must hit starter mechanism 22 to begin movement of timer 20. If the player has made a spin resulting in the number two (II), then the player must form at least two words which rhyme with the selected card 50 in order to move two spaces. If word card 50 having the word 52 "CAT" thereon is drawn, the player must make the rhymes "RAT" and "HAT", for example. Preferably, once the player has made the number of rhymes the player is able to make, the player hits stop switch 24 to stop timer 20. Timer 20 will sound an audible alarm, preferably, if the player has not hit stop switch 24 within a predetermined period of time, such as ten seconds.

The player who has successfully made two word rhymes with the selected card 50 advances the two spaces, as shown by the location of gamepiece 18 on a blank space 100, the player having moved started from start space 12 and moved in the direction of arrow 18.

The next player now has his or her turn, and the game continues.

When a player, i.e., the player's gamepiece 16, ends up on a rhyme-to-go-again space 104, which may have the phrase such as "RHYME WORD THREE TIMES TO SPIN AGAIN" printed thereon, then the player must select one of word cards 50 and form three rhymes during the allotted time governed by timer 20. If the player is unable to form the required number of rhymes, play passes to the next player. If the player successfully forms the required number of rhymes, that player is allowed to spin again, and that player draws another card and forms the number of rhymes designated by spinner 30 and proceeds with movement along the path of travel as outlined above.

A start-again space 108 is provided that requires a player whose gamepiece 18 lands thereon to return to start space 12, and pass play to the next player.

Likewise, there is a lose turn space 112 which causes a player to wait out a turn if movement of his o her gamepiece 16 onto lose-turn space 112 occurs.

A rhyme-or-lose-turn space 116 is also provided. A corresponding written or symbolic representation of such concept may include a phrase such as "RHYME WORD FOUR TIMES OR LOSE TURN". If a player who lands on rhyme-or-lose-turn space 116 is unable to form words which rhyme with a card drawn from the upside down stack of cards 50, the player loses a turn, in a manner analogous to the situation in which a player had simply landed on lose-turn space 112, yet with an opportunity to avoid losing a turn by forming the required number of rhymes.

To enhance the entertainment value of the educational word rhyming game, one or more of the spaces may be made as a decorative space 120. Preferably, decorative spaces 120 have a theme corresponding to the general theme depicted on gameboard 10.

A power plot space 124 is included to enhance the amusement value of the game by providing a player who lands thereon to interact with the other players. When the player has gamepiece 18 on power plot space 124, that player may either change positions with another player, the other player being closer to finish space 14, for example, and having a better position in the game.

In addition, the player who lands on power plot 124 is allowed to cause two other players to exchange places on gameboard 10 amongst themselves. Such an option would be exercised when the player on power plot 124 recognizes that another player closest to finish space 14 is a more powerful player than another player further from finish space 14 than that other powerful player, whereby the player on power plot space 124 may gain an advantage by setting back the more powerful player.

Furthermore, a number of shortcut-path spaces 128 are provided, such shortcut-path spaces 128 including exemplary instructions: "SHORTCUT/RHYME WORD FOUR TIMES". Shortcut-path space 128 is directly connected to an elongated shortcut path 132 which is, in turn, directly connected to a blank space 136 located at the end of shortcut path 132. The player who lands on shortcut-path space 128 and successfully makes the required number of rhymes corresponding to card 50 drawn from the stack of cards moves his or her gamepiece 18 along shortcut pat 132 and lands on blank space 136. Such player has gained an advantage by moving closer to the finish over a shorter travel path than would have been required otherwise.

Additionally, one or more override card spaces 140 are provided along the path of travel. Override card spaces 140 allow the player whose gamepiece 18 lands thereon to take one override card 144 from the stack of override cards. The player retains override card 144 and may use such card when he or she lands on a space having commands which hurt, or potentially hurt, the player's position relative to finish space 14. For example, if a player lands on a setback space 148 requiring the player to take a setback shortcut 152 back to a blank space 156 at the end of setback shortcut 152 that is further away from finish space 14 than setback space 148, then the player may turn in his or her override card 144 and ignore the instructions on setback space 148. An override card 144 may be used to override any negative circumstance, that is any space which directly or indirectly causes the player to have a setback.

The first player whose gamepiece 18 reaches finish space 14 is the winner.

It will be obvious to a person having ordinary skill in the art that a more traditional, hourglass timer can be used in place of the electromechanical timer having start and stop switches.

For very young players, the use of the timer may be omitted entirely.

The gamepieces may be simple cylinders, as shown, or any other tokens designating a particular player.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A method of playing an educational word rhyming game, comprising:

a) providing an educational word rhyming game, including:

i) gameboard means for defining a plurality of substantially consecutive spaces defining a movement path;

ii) one of said spaces being a start space and one of said spaces being a finish space;

iii) a plurality of game pieces positionable on each one of said plurality of spaces for movement along said movement path;

iv) a plurality of rhyming cards having at least one word disposed thereon; and v) means for determining a number of times a player must form a rhyme corresponding to one of said at least one word disposed on one of said rhyming cards;

f) establishing the order of play;

g) using the determining means;

h) a player trying to form the number of words established by the determining means; and i) moving a gamepiece along a number of spaces corresponding to the number of times a player must form a rhyme determined by the determining means.

2. A method of playing an educational word rhyming game as defined in claim 1, further comprising the step of:

a) providing a shortcut path space on said gameboard means that extends between a first one of said plurality of consecutive spaces and a second one of said plurality of consecutive spaces, said first and second ones of said spaces being spaced apart from each other.

3. A method of playing an educational word rhyming game as defined in claim 1, further comprising the step of:

a) setting a length of time in which a player must form a rhyme corresponding to said one of said at least one word disposed on one of said rhyming cards.

4. A method of playing an educational word rhyming game as defined in claim 1, further comprising the step of:

a) providing a start-again command space on said gameboard means, said start-again command space having means disposed thereon for instructing a player to move the player's gamepiece back to said start space, when the player's gamepiece lands on said start again command space.

5. A method of playing an educational word rhyming game as defined in claim 1, further comprising the step of:

a) providing a rhyme-to-go-again space on said gameboard means, said rhyme-to-go-again space having means disposed thereon for instructing a player to form a rhyme of a word in order for the player to have another turn of play, when the player's gamepiece lands on said rhyme-to-go-again space.

6. A method of playing an educational word rhyming game as defined in claim 1, further comprising the step of:

a) providing a lose-turn command space on said gameboard means, said lose-turn command space having means disposed thereon for instructing a player to lose a turn, when the player's gamepiece lands on said lose-turn command space.

7. A method playing an educational word rhyming game as defined in claim 6, further comprising the step of:

a) providing a plurality of override cards, whereby a player who has an override card may ignore the instructions disposed on a lose-turn command space.

8. A method of playing an educational word rhyming game as defined in claim 1, further comprising the step of:

a) providing a rhyme-or-lose-turn command space on said gameboard means, said rhyme-to-lose-turn command space having means disposed thereon for instructing a player to form a rhyme of a word in order to avoid losing a turn, when a player's gamepiece lands on said rhyme-or-lose-turn command space.

9. An educational rhyming game as defined in claim 1, further comprising the step of:

a) providing a power plot space on said gameboard means, said power plot space having means disposed thereon for indicating that said power plot space is a power plot space, whereby a first player's gamepiece landing on said power plot space allows the first player to cause a second player to exchange the second player's gamepiece with the first player's gamepiece, and, alternatively, the first player may cause third and fourth players to exchange their respective gamepieces, thereby altering the locations of various players' gamepieces on said gameboard means.

* * * * *